US008151585B2

(12) United States Patent
Douglas et al.

(10) Patent No.: US 8,151,585 B2
(45) Date of Patent: Apr. 10, 2012

(54) SYSTEM AND METHOD OF DISABLING AN HVAC COMPRESSOR BASED ON A LOW PRESSURE CUT OUT

(75) Inventors: Jonathan D. Douglas, Bullard, TX (US); John R. Edens, Kilgore, TX (US); Alan D Marble, Whitehouse, TX (US); Kevin B. Mercer, Troup, TX (US); Gary L. Sapp, Tyler, TX (US); Brett R. Schneider, Tyler, TX (US); Steven A. Tice, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 866 days.

(21) Appl. No.: 12/238,988

(22) Filed: Sep. 26, 2008

(65) Prior Publication Data

US 2010/0080713 A1 Apr. 1, 2010

(51) Int. Cl.
*F25B 1/00* (2006.01)
*F25B 49/00* (2006.01)

(52) U.S. Cl. ..... 62/228.3; 62/231

(58) Field of Classification Search ..... 62/157, 62/160, 228.3, 228.5, 231
See application file for complete search history.

(56) References Cited

U.S. PATENT DOCUMENTS 4,221,116 A * 9/1980 Harnish ..... 62/209
4,326,387 A 4/1982 Friedman
4,467,613 A 8/1984 Behr et al.
4,602,484 A * 7/1986 Bendikson ..... 62/158
4,749,881 A 6/1988 Uhrich
4,974,420 A 12/1990 Kramer
5,138,844 A 8/1992 Clanin et al.
5,377,497 A 1/1995 Powell
5,507,154 A 4/1996 Grant
5,605,053 A 2/1997 Otori
5,689,963 A * 11/1997 Bahel et al. ..... 62/129
5,970,727 A 10/1999 Hiraoka et al.
6,021,644 A 2/2000 Ares et al.
6,181,538 B1 1/2001 Yoo
6,216,479 B1 4/2001 Elwood
6,434,957 B1 8/2002 Nishizuka et al.
6,842,650 B2 1/2005 Bennett
7,024,254 B2 4/2006 Salsbury et al.
7,222,494 B2 5/2007 Peterson et al.

OTHER PUBLICATIONS

Douglas, Jonathan D.; U.S. Appl. No. 12/238,966; "System and Method of Disabling An HVAC Compressor Based on a High Pressure Cut Out"; Filing Date Sep. 26, 2008; Specification 28 pgs.; Drawing Sheets (Figs. 1-2, 3A-3B).

* cited by examiner

*Primary Examiner* — Marc Norman
(74) *Attorney, Agent, or Firm* — Conley Rose, P.C.; J. Robert Brown, Jr.

(57) ABSTRACT

A system and method is provided for monitoring a system pressure to infer whether a high pressure cut out (HPCO) switch has opened disabling a heating, ventilating, and air conditioning (HVAC) compressor. A system and method are also provided for determining whether to disable the heating, ventilating, and air conditioning (HVAC) compressor based on a status of a low pressure cut out (LPCO) switch, an ambient temperature, and system mode state. The systems and methods may be used interchangeably with the appropriate adjustments to decision limits, such as where the LPCO may be monitored to infer status and the HPCO status may be directly used with temperature and system mode state.

30 Claims, 4 Drawing Sheets

SYSTEM AND METHOD OF DISABLING AN HVAC COMPRESSOR BASED ON A LOW PRESSURE CUT OUT

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

Compressors used in heating, ventilating, and air conditioning (HVAC) systems are connected to lines carrying refrigerants that are under pressure. For various reasons, pressure in these systems fluctuate which can cause inefficiencies, mechanical problems, and even premature failure of HVAC systems and components, such as compressors.

SUMMARY OF THE DISCLOSURE

In one embodiment, a system is provided that includes a compressor, a heat exchanger, and at least one refrigerant line to promote movement of refrigerant between the compressor and the heat exchanger. The system also includes a high pressure cut out (HPCO) switch to promote disabling the compressor based on a system pressure, and a pressure sensor to monitor the system pressure. The system also includes a control component, configured based on the system pressure monitored by the pressure sensor to infer a status of the HPCO switch.

In other embodiments, a system to reduce heating, ventilating, and air conditioning (HVAC) compressor wear is provided. The system includes a processor and a component configured to receive information related to a system pressure monitored by one or more pressure sensors and to use the information to infer whether a high pressure cut out (HPCO) switch has opened.

In yet other embodiments, a method to reduce heating, ventilating, and air conditioning (HVAC) compressor wear is provided. The method includes monitoring a system pressure to infer whether a high pressure cut out (HPCO) switch has opened.

In other embodiments, a system is provided that includes a compressor, a heat exchanger, at least one refrigerant line to promote communication of refrigerant between the compressor and the heat exchanger. The system includes a low pressure cut out (LPCO) switch to promote disabling the compressor based on a system pressure, and an ambient temperature sensor configured to determine an ambient temperature. The system includes a control component coupled to communicate with the LPCO switch and the ambient temperature sensor, the component configured to determine a mode state of the system and to disable the compressor based on a status of the LPCO switch, the ambient temperature, and the mode state.

In another embodiment, a method is provided that includes determining a mode state of the system, determining a status of an LPCO switch, and determining an ambient temperature. The method includes determining whether to disable the compressor based on a status of the LPCO switch, the ambient temperature, and the mode state.

The various characteristics described above, as well as other features, will be readily apparent to those skilled in the art upon reading the following detailed description of the embodiments of the disclosure, and by referring to the accompanying drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments of the present disclosure are provided below, the disclosed methods and/or systems may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Compressors used in HVAC systems typically have high pressure cutout (HPCO) and low pressure cutout (LPCO) safety switches installed in their refrigerant lines to prevent the compressors from operating under abnormal system conditions and being damaged as a result. For example, an abnormally high or low refrigerant line pressure causes the respective HPCO or LPCO switch to open, which breaks an electrical connection to the compressor's contact relay coil and turns the compressor off. The HVAC system then periodically attempts to turn the compressor back on. However, during each such attempt, if the HPCO or LPCO switch is still open, then the compressor turns off. After the underlying problem is corrected and normal high and low line pressures are achieved, the HPCO or LPCO switch closes and thus enables the system to run the compressor for an extended period of time.

This process of turning on and then turning back off again quickly and running more often for shorter periods of time while an HPCO or LPCO switch is open is referred to as a "short-cycle" or "short-cycling" of the compressor. Such excessive on/off "short-cycling" decreases the reliability and performance life of the compressor.

Furthermore the HPCO switch or LPCO switch can be inadvertently tripped or inferred to trip. For example, an HPCO switch can be inadvertently inferred to trip due to a drop in ambient temperature caused by a typical summer storm. Also for example, an LPCO switch can be inadvertently tripped due to low ambient cooling or operating in an extremely low ambient heating mode. Under normal operating conditions, there may be a minimum required compressor off time (e.g., 5 minutes) if an HPCO or LPCO switch is tripped. However, if an HPCO or LPCO switch is inadvertently tripped, then the compressor may be cycled off and remain inoperable for the entire required off time.

Figure 1:
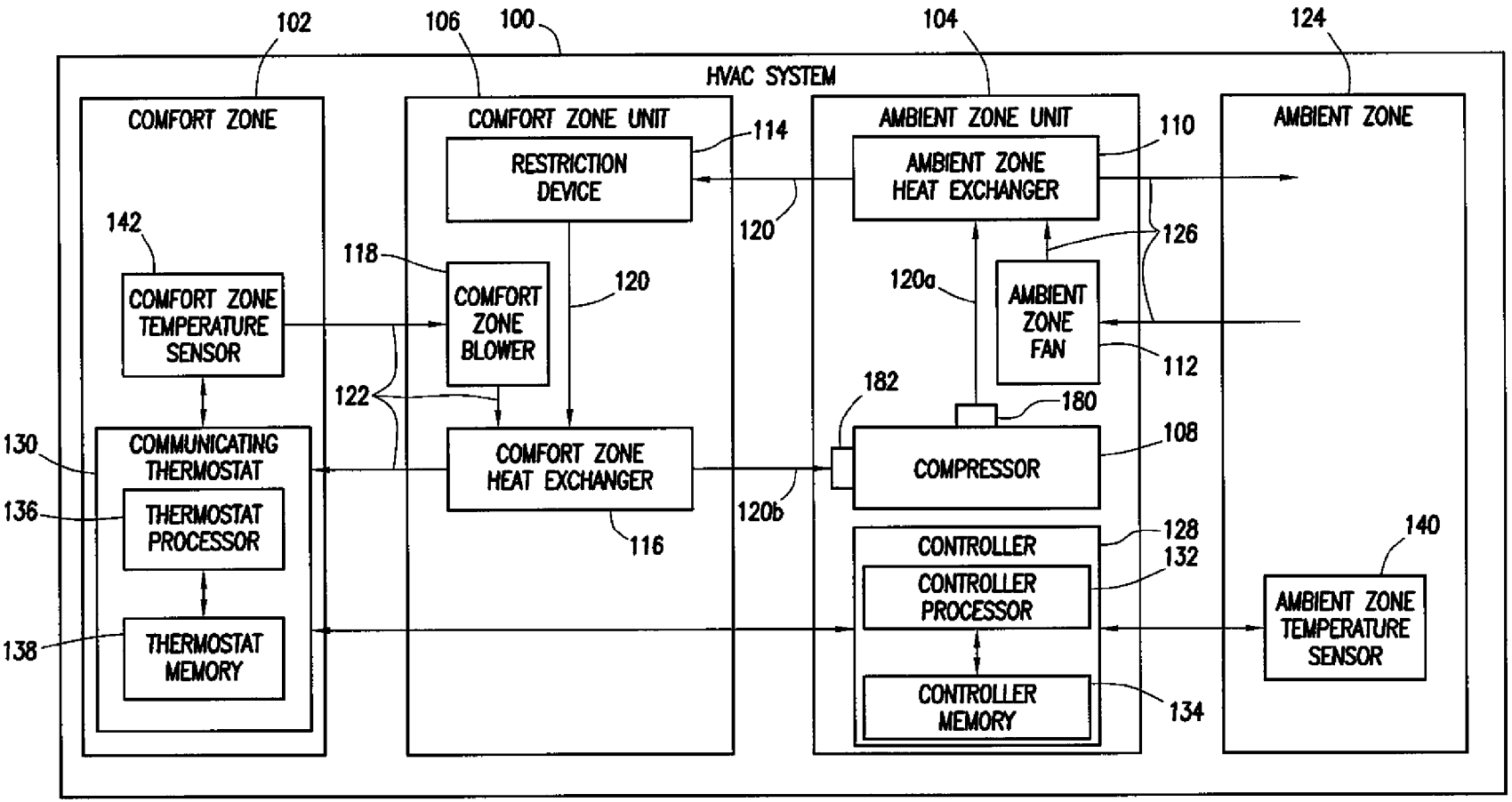
FIG. 1 is a block diagram of an exemplary HVAC system, which may be used to implement one or more embodiments of the disclosure.

FIG. 1 is a simplified schematic diagram of an HVAC system 100 according to an embodiment. The HVAC system 100 operates to selectively control the temperature, humidity, and/or other air quality factors of a comfort zone 102. The HVAC system 100 generally comprises an ambient zone unit 104 and a comfort zone unit 106. The ambient zone unit 104 comprises a compressor 108, an ambient zone heat exchanger 110, and an ambient zone fan 112. The comfort zone unit 106 comprises a restriction device 114, a comfort zone heat exchanger 116, and a comfort zone blower 118. Refrigerant is carried between the compressor 108, the ambient zone heat exchanger 110, the restriction device 114, and the comfort zone heat exchanger 116 through refrigerant tubes 120. The comfort zone blower 118 forces air from the comfort zone 102, into contact with the comfort zone heat exchanger 116, and subsequently back into the comfort zone 102 through air ducts 122. Similarly, the ambient zone fan 112 forces air from an ambient zone 124, into contact with the ambient zone heat exchanger 110, and subsequently back into the ambient zone 124 along an ambient air flow path 126. The HVAC system 100 is generally controlled by interactions between a controller 128 and a communicating thermostat 130. The controller 128 comprises a controller processor 132 and a controller memory 134 while the communicating thermostat 130 comprises a thermostat processor 136 and a thermostat memory 138. Further, the controller 128 communicates with an ambient zone temperature sensor 140 while the communicating thermostat 130 communicates with a comfort zone temperature sensor 142. In this embodiment, communications between the controller 128 and the communicating thermostat 130, the controller 128 and the ambient zone temperature sensor 140, the communicating thermostat 130 and the comfort zone temperature sensor 142, the controller processor 132 and the controller memory 134, and the thermostat processor 136 and the thermostat memory 138, are capable of bidirectional communication. However, in alternative embodiments, the communication between some components may be unidirectional rather than bidirectional.

The HVAC system 100 may be referred to as a "split-system" because the compressor 108, the ambient zone heat exchanger 110, and the ambient zone fan 126 are colocated in the ambient zone unit 104 while the restriction device 114, comfort zone heat exchanger 116, and comfort zone blower 118 are colocated in the comfort zone unit 106 separate from the ambient zone unit 104. However, in alternative embodiments of an HVAC system, substantially all of the components of the ambient zone unit 104 and the comfort zone unit 106 may be colocated in a single housing in a system called a "package system." Further, in alternative embodiments, an HVAC system may comprise heat generators such as electrically resistive heating elements and/or gas furnace elements so that a comfort zone heat exchanger and the heat generators are both in a shared airflow path of a comfort zone blower.

While the comfort zone 102 may commonly be associated with a living space of a house or an area of a commercial building occupied by people, the comfort zone 102 may be also be associated with any other area in which it is desirable to control the temperature, humidity, and/or other air quality factors (i.e. computer equipment rooms, animal housings, chemical storage facilities, and so on). Further, while the comfort zone unit 106 is shown as being located outside the comfort zone 102 (i.e. within an unoccupied attic or crawl-space), the comfort zone unit may alternatively be located within or partially within the comfort zone 102 (i.e. in an interior closet of a building).

Each of the ambient zone heat exchanger 110 and the comfort zone heat exchanger 116 may be constructed as air coils, shell and tube heat exchangers, plate heat exchangers, regenerative heat exchangers, adiabatic wheel heat exchangers, dynamic scraped surface heat exchangers, or any other suitable form of heat exchanger. The compressor 108 may be constructed as any suitable compressor, for example, a centrifugal compressor, a diagonal or mixed-flow compressor, an axial-flow compressor, a reciprocating compressor, a rotary screw compressor, a rotary vane compressor, a scroll compressor, or a diaphragm compressor. In this embodiment, the compressor 108 is capable of operating in multiple stages (e.g., stage A and stage B). For example, the compressor 108 can be operated at a low speed (stage A) or a high speed (stage B). Alternative embodiments of an HVAC system may comprise more than one compressor and the compressors may be operable at more than one speed or at a range of speeds (i.e., a variable speed compressor). Further, while the HVAC system 100 is shown as operated in a cooling mode to remove heat from the comfort zone 102, the HVAC system 100 is configured as a "heat pump" system that selectively allows flow of refrigerant in the direction shown in FIG. 1 to cool the comfort zone 102 or in the reverse direction to that shown in FIG. 1 to heat the comfort zone 102 in a heating mode. It will further be appreciated that in alternative embodiments, a second restriction device substantially similar to restriction device 114 may be incorporated into an ambient zone unit to assist with operation of an HVAC system in a heating mode substantially similar to the heating mode of HVAC system 100. Also, HVAC system 100 may be configured as a "cooling only" system allowing only the direction of refrigerant flow shown in the cooling mode.

In the cooling mode, the compressor 108 operates to compress low pressure gas refrigerant into a hot and high pressure gas that is passed through the ambient zone heat exchanger 110. As the refrigerant is passed through the ambient zone heat exchanger 110, the ambient zone fan 112 operates to force air from the ambient zone 124 into contact with the ambient zone heat exchanger 110, thereby removing heat from the refrigerant and condensing the refrigerant into high pressure liquid form. The liquid refrigerant is then delivered to the restriction device 114. Forcing the refrigerant through the restriction device 114 causes the refrigerant to transform into a cold and low pressure gas. The cold gas is passed from the restriction device 114 into the comfort zone heat exchanger 116. While the cold gas is passed through the comfort zone heat exchanger 116, the comfort zone blower 118 operates to force air from the comfort zone 102 into contact with the comfort zone heat exchanger 116, heating the refrigerant and thereby providing a cooling and dehumidifying effect to the air, which is then returned comfort zone 102. In this embodiment, the HVAC system is using a vapor compression cycle, namely, the Rankine cycle. In the heating mode, generally, the direction of the flow of the refrigerant is reversed (compared to that shown in FIG. 1) so that heat is added to the comfort zone 102 using a reverse-vapor-compression cycle, namely, the reverse-Rankine cycle. It will be appreciated that alternative embodiments of an HVAC system may use any other suitable thermodynamic cycle for transferring heat to and/or from a comfort zone.

Generally, the controller 128 communicates with the ambient zone temperature sensor 140 that is located in the ambient zone 124 (i.e. outdoors, outdoors within the ambient zone unit in an embodiment where the ambient zone unit is located in the ambient zone, adjacent the ambient zone unit in an embodiment where the ambient zone unit is located in the ambient zone, or any other suitable location for providing an ambient zone temperature or a temperature associated with the ambient zone). While the controller 128 is illustrated as positioned within the ambient zone unit 104, in alternative embodiments, the controller 128 may be positioned adjacent to but outside an ambient zone unit, outside a comfort zone, within a comfort zone unit, within a comfort zone, or at any other suitable location. It will be appreciated that in alternative embodiments, an HVAC system may comprise a second controller substantially similar to controller 128 and that the second controller may be incorporated into a comfort zone unit substantially similar to comfort zone unit 106. In the embodiment shown in FIG. 1, through the use of the controller processor 132 and the controller memory 134, the controller 128 is configured to process instructions and/or algorithms that generally direct the operation of the HVAC system 100.

In the present embodiment, HVAC system 100 also may include an HPCO switch 180 installed in a discharge line of compressor 108 and coupled to flow-line 120*a*, and an LPCO switch 182 installed in a suction line of compressor 108 and coupled to flow-line 120*b*. The HPCO switch 180 may be configured to sense the pressure of the vapor at the discharge line or output of compressor 108 and may open if this pressure approaches a predefined high pressure cutout limit value. The LPCO switch 182 may be configured to sense the pressure of the refrigerant at the suction line or input of compressor 108 and may open if this pressure approaches a predefined low pressure cutout limit value. If either the HPCO switch or LPCO switch is open (e.g., due to an abnormal line pressure, etc.), an electrical connection (not shown) to the compressor or to the controller is broken and the compressor is turned off.

High Pressure Cut Out

The status of the HPCO switch, such as whether it is open or closed, may be determined by directly monitoring the switch. For example, a direct electrical connection may be made to the switch to detect whether the switch is open. Also such monitoring and detection of the status of the compressor, such as whether the compressor is receiving power, might provide helpful information for HVAC system operation control related to the HPCO switch status.

In some instances however such direct detection may not be possible or desirable. Instead the present disclosure describes systems and methods for inferring the status of the HPCO switch by monitoring aspects of the system pressure via one or more pressure sensors. For example, when the system pressure rises above an upper threshold (which might typically cause the HPCO switch to open) and then the system pressure subsequently falls below a lower threshold (which might typically follow a compressor shut-down), the present disclosure infers that the HPCO switch opened and shut-down the compressor. Thereafter the present disclosure might take certain actions, for example, disengaging the compressor for a period of time to prevent short-cycling, cycling on a high pressure limit indefinitely, and the associated detrimental effects. Additional system capabilities, details, and advantages are provided below.

Figure 2:
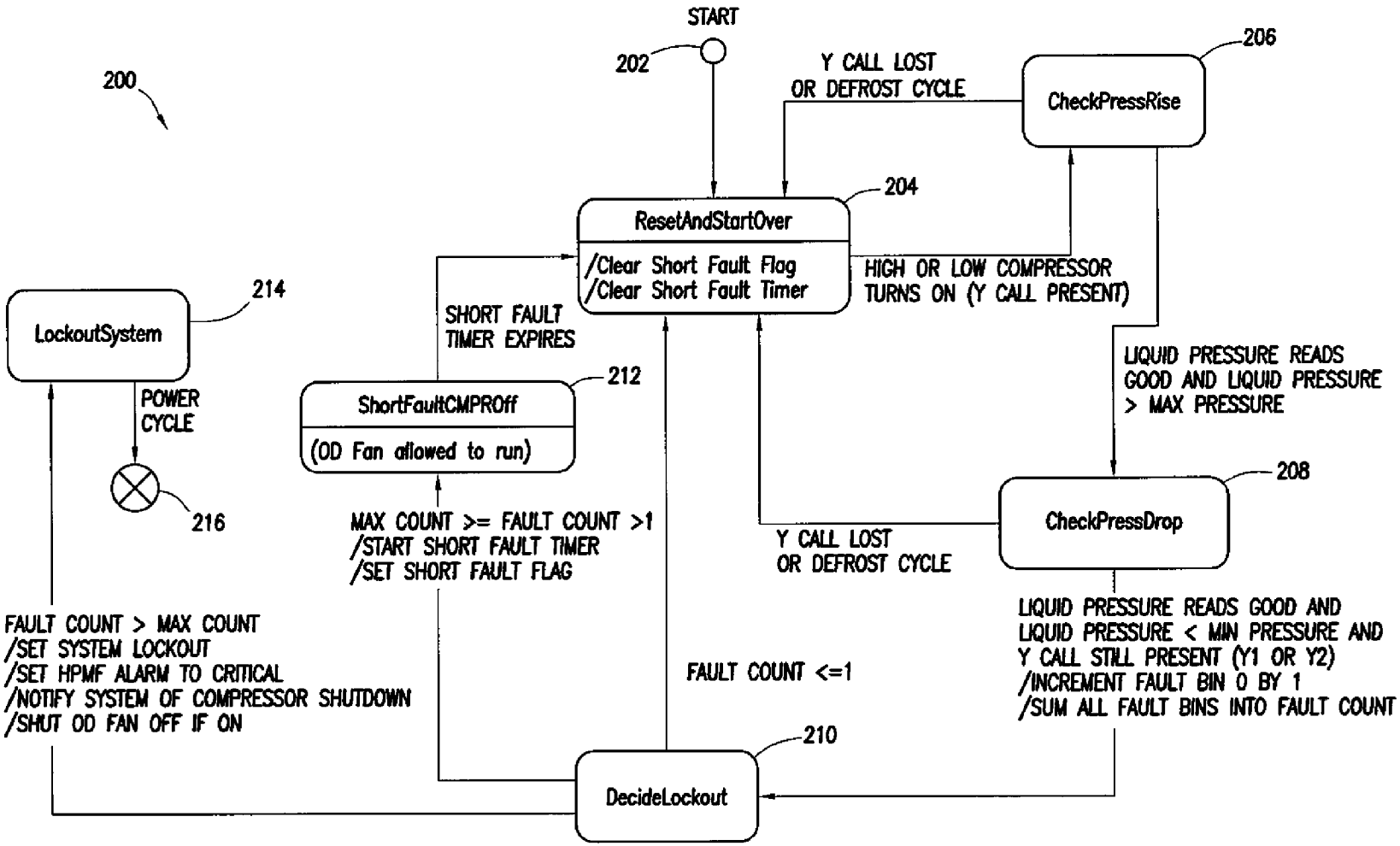
FIG. 2 is a flow chart depicting an exemplary method of increasing compressor reliability, which may be implemented in accordance with the principles disclosed herein.

FIG. 2 is a flowchart depicting an exemplary high pressure cutout control method 200 for an HVAC system, which may be used to implement one or more embodiments of the present disclosure. For example, in some embodiments, method 200 may be used to implement high pressure cutout control functionality in the exemplary HVAC system 100 depicted in FIG. 1. The method 200 may be used to increase the reliability of a compressor by preventing it from cycling indefinitely on a high pressure limit, and/or preventing a compressor from cycling too often while an associated HPCO switch 180 is open. Also, if a compressor repeatedly cuts out due to high line pressures, method 200 may be used to disable the compressor until suitable remedial action may be taken (e.g., a technician may be called to diagnose and correct a fault). Method 200 may be implemented without additional hardware (e.g., additional switches and the like) or directly monitoring the HPCO switch.

Referring to FIGS. 1 and 2, method 200 may be implemented, for example, in a state machine and executed as software, middleware, and/or firmware by a controller 128 and control processor 132. Method 200 may begin at an initial state 202 and proceed to a reset/start-over state 204. In this state, the controller 128 and control processor 132 may initialize a high pressure cutout control procedure for HVAC system 100 by clearing one or more fault-related flags and/or timers that are associated with high pressure cutout control. For example, method 200 may clear a "short-cycle" fault flag and/or a "short-cycle" fault timer in order to reset and initialize a high pressure cutout control procedure for compressor 108 during an excessive interval of "short-cycling".

Next, if the compressor involved is turned on (e.g., controller 128 and control processor 132 may determine that a "Y" call or suitable other heating or cooling demand call from communicating thermostat 130 has been retrieved or received and either a high stage or low stage compressor has turned on), method 200 may determine whether or not the refrigerant pressure in the compressor's high pressure line has increased to a predetermined high pressure threshold value (state 206). As used herein, "Y" or "Y call" may refer to a state of the compressor, such as a continuous run of the compressor at a given state.

Control processor 132 may retrieve or receive high pressure values or data from one or more suitable pressure sensors (not shown) attached to or disposed in high pressure flow-line 120*a*. For an example refrigerant such as R-410A, the high pressure threshold value can fall within a range of pressure values between 590-625 psig (e.g., a threshold value of 595 psig). While in this state, if the compressor involved is turned off (e.g., control processor 132 may determine that the demand or "Y" call is no longer present, or the HVAC system is now operating in a defrost cycle), then method 200 proceeds back to the initialization state 204.

However, if in state 206, method 200 determines that the refrigerant pressure in the compressor's high pressure line is at or higher than the predetermined high threshold value, then method 200 determines whether or not the vapor pressure in the compressor's high pressure line has decreased to a predetermined low threshold value (state 208). Such a pressure drop may infer that the compressor is turned off. Again, for example, control processor 132 may retrieve or receive high pressure values or data from one or more suitable pressure sensors (not shown) attached to or disposed in high pressure flow-line 120*a*. For an example refrigerant such as R-410A, the low pressure threshold value can fall within a range of pressure values between 490-550 psig (e.g., a threshold value of 535 psig). While in this state, if the compressor involved is turned off (e.g., control processor 132 may determine that the demand or "Y" call is no longer present, or the HVAC system is now operating in a defrost cycle), then method 200 proceeds back to the initialization state 204.

Next, if method 200 subsequently determines that the refrigerant pressure in the compressor's high pressure line 120*a* falls to or less than the low pressure threshold value, method 200 may determine that a high pressure cutout event has occurred (e.g., as a result, the compressor has shut down) and may proceed to a lock out decision state 210. For example, while in state 208, if control processor 132 determines that the refrigerant pressure in the compressor's high pressure line is less than the low pressure threshold value and a high pressure cutout event has thus occurred, the control processor 132 may increment a fault bin 0 (e.g., in a memory storage area) by the value 1, and also sum up all of the fault bin values to form a total Fault Count value.

In some embodiments, method 200 may use multiple bins, such as 12 bins, to track the overall time interval during which high pressure cutout events may have occurred. In this embodiment, each bin of the 12 bins may represent a specific "bin timer length" (e.g., time interval between 0.5-3 hours, such as 2 hours). Consequently, for example, the use of 12 bins may represent a 22-24 hour window for the overall length of the bin timer involved.

While in the lock out decision state 210, method 200 may determine whether or not the value of the Fault Count is less than or equal to 1. If the Fault Count value is less than or equal to 1, method 200 may proceed back to the initialization state 204. If the Fault Count value is greater than 1, and the maximum count value (e.g., total number of high pressure events that have occurred over all 12 bins) is greater than or equal to the Fault Count value, method 200 may initiate a "short" lock out event (state 212). For example, during this state, control processor 132 may start a "Short Fault" timer and set a "Short Fault" flag. In response to a "short" lock out event, control processor 132 may cause the compressor to be disabled for a predetermined period of time (e.g., the value of the "Short Fault" timer). An example "short" lock out time period that may be used is three to six minutes, (e.g. five minutes), and during this time period, the outdoor fan (e.g., fan 114) may remain energized and operating or may be disabled as well. When the "short" lock out time period is expired (e.g., the Short Fault" timer has counted down to zero), method 200 may proceed back to the initialization state 204.

Returning to the lock out decision state 210, if method 200 determines that the value of the "Fault Count" is greater than the maximum count value, method 200 may initiate a "hard" lock out event (state 214). For example, in response to a "hard" lock out event, control processor 132 may set a system lock out that disables the compressor and the outdoor fan. The control processor 132 may also set a "call for service" flag to notify the HVAC system that service should be performed to clear the fault. The "hard" lock out event may be continued until method 200 determines that a power cycle or reset event 216 has occurred.

It is readily apparent to one of ordinary skill in the art that different processes or steps may be implemented to promote monitoring the system pressure as a means for inferring whether the HPCO switch has opened. Method 200 is merely exemplary of one such process, and the present disclosure should not be limited to this specific implementation since others are contemplated and will suggest themselves to one skilled in the art in view of the present disclosure and teachings.

Low Pressure Cut Out

Similar problems may exist in low pressure situations. Accordingly the present disclosure provides for similar systems and methods to prevent short cycling or cycling indefinitely when the LPCO switch is opened as was disclosed for the HPCO. Furthermore, alternate systems and methods are disclosed where the system repeatedly cuts out on low pressure above a threshold ambient temperature, the present disclosure provides for disabling the compressor until serviced by a technician. When the system cuts out at an ambient temperature below the threshold, the present disclosure promotes disabling the compressor until the ambient temperature rises.

Unlike the high pressure system example discussed above where the pressure was monitored because the HPCO switch was not directly monitored, in the present embodiment of the low pressure cut out, the LPCO switch may be monitored directly. As will be apparent to those skilled in the art based on the present disclosure, by inverting the high and low threshold limits, either method would apply to either switch type, depending on whether the choice is made to directly monitor the switch or to monitor the refrigerant pressure.

Figure 3A:
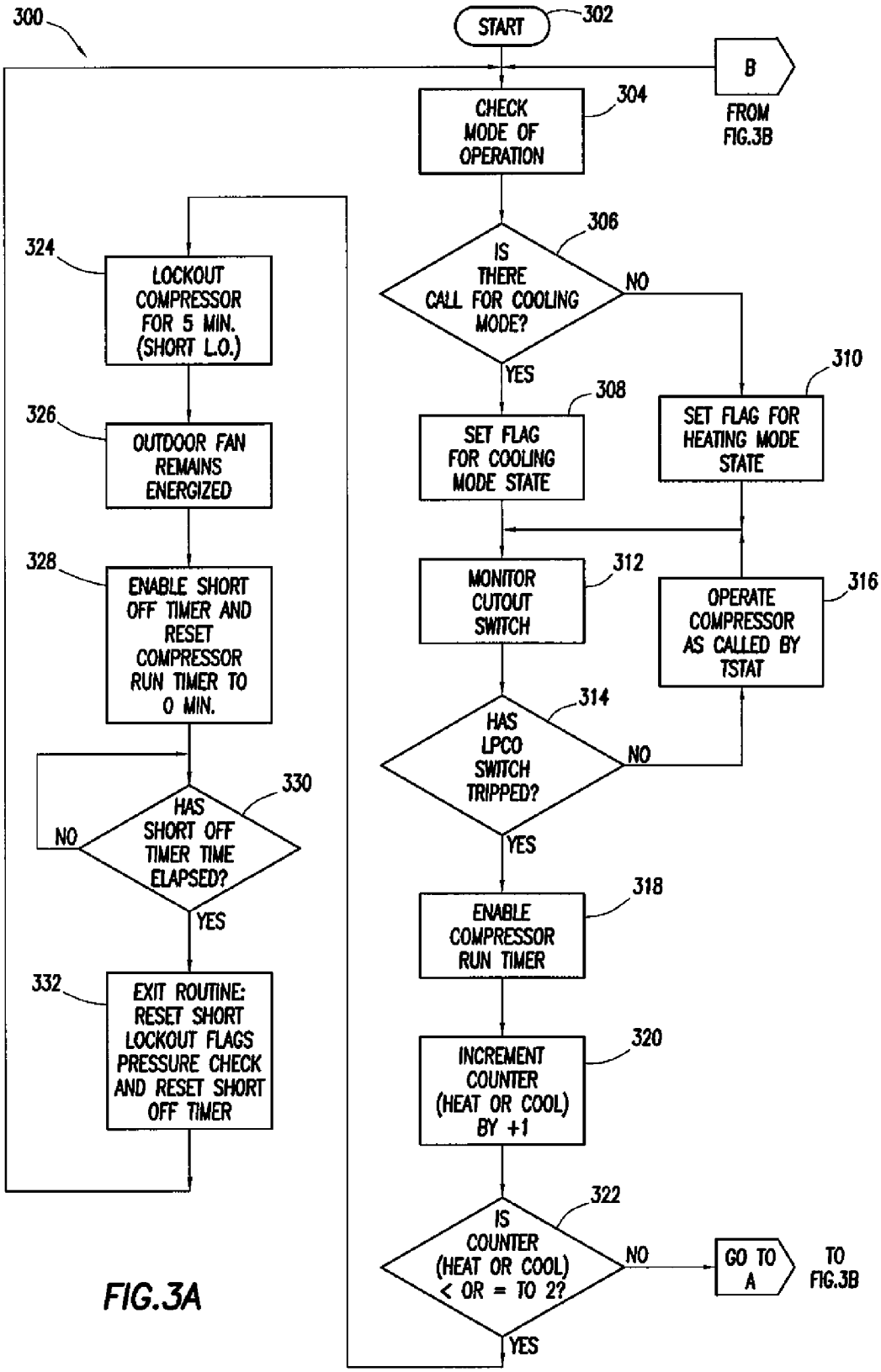
FIGS. 3A and 3B are related flowcharts depicting a second exemplary method of increasing compressor reliability, which also may be implemented in accordance with the principles disclosed herein.
Figure 3B:
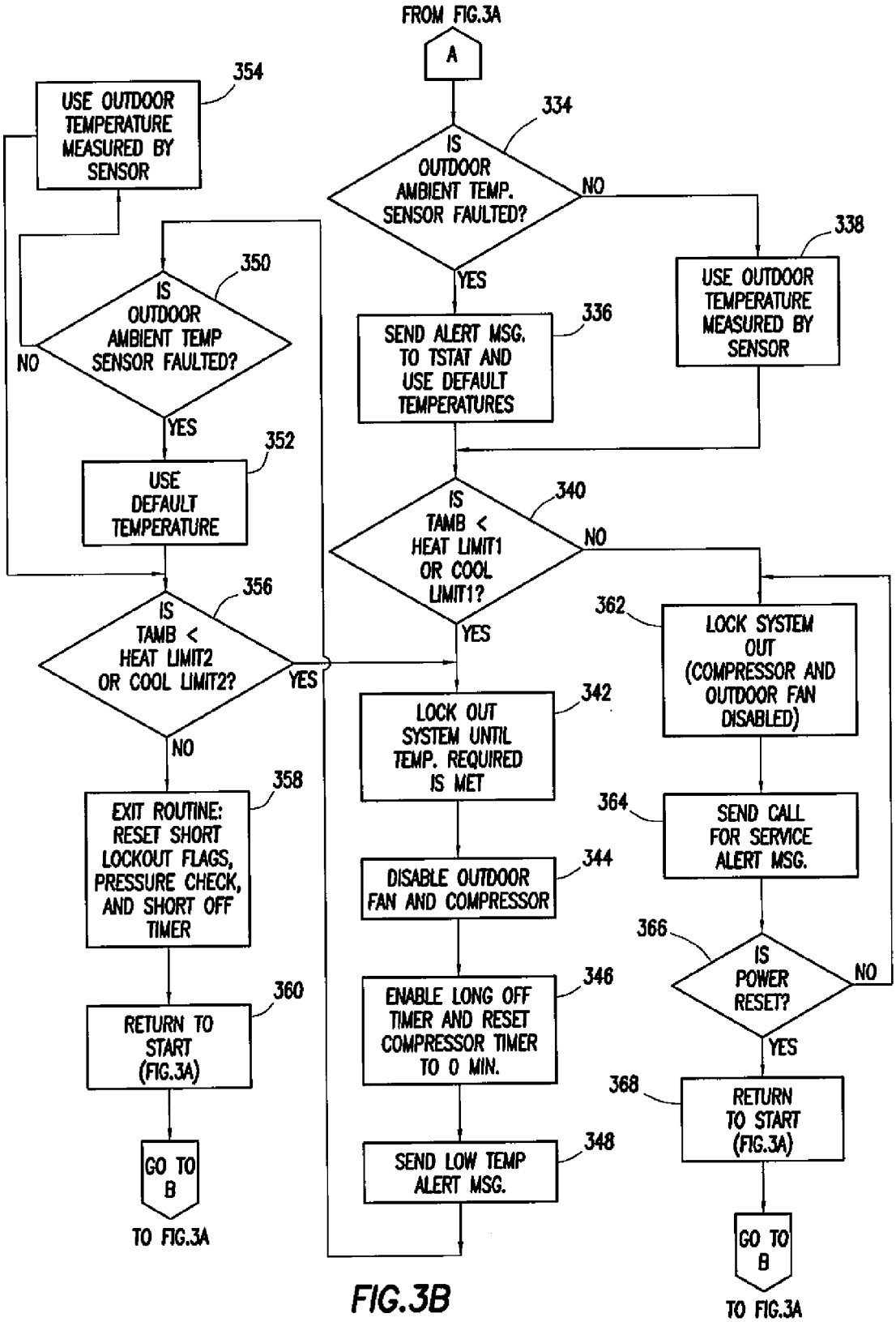

FIGS. 3A and 3B are related flowcharts depicting an exemplary low pressure cut out control method 300 for an HVAC system, which may be used to implement one or more embodiments of the present disclosure. For example, in some embodiments, method 300 may be used to implement low pressure cutout control functionality in the exemplary HVAC system 100 depicted in FIG. 1. The method 300 may be implemented, for example, in a state machine and executed as software, middleware, and/or firmware by a controller 128 and control processor 132. Method 300 may begin at an initial state 302 and proceed to block 304 to check the mode of operation. At decision block 306, if the system is in a cooling mode, the process branches to block 308 and a flag is set for cooling mode state. Otherwise at decision block 306, if the system is in a heating mode, the process branches to block 310 and a flag is set for heating mode state.

Regardless of the system mode, the method 300 then proceeds to block 312 where the LPCO switch is monitored. In the present disclosure, it is preferable to implement the method 300 anytime the HVAC system 100 includes a LPCO switch 182. At decision block 314, when the LPCO switch has not tripped, the process proceeds to block 316 where the system continues to operate as called the by the thermostat 130 and the LPCO switch may continue to be monitored. At decision block 314 when the LPCO switch has tripped, the process proceeds to block 318 where a compressor run timer is enabled. The process then proceeds to 320 where either a cool or heat counter is incremented depending on the mode that the system is in when the LPCO switch is tripped. The cool and heat counters may be periodically reset to zero. For example, after five hours of accumulated compressor run time since either counter was last incremented the counters may be reset. In other embodiments, run times that are shorter or longer than five hours might be required before resetting the counters.

At decision block 322, a lock out counter that tracks the number of previous lock outs is checked. In this embodiment, if the lock out counter is less than or equal to two, the process branches to block 324 which initiates a short lock out turning off the compressor. The threshold number of lock outs before initiating a short or hard lock out may be in a range of integers, but is two in the present embodiment. A higher threshold setting before initiating a hard lock out may reduce the nuisance related to a compressor lock out and associated disruption of the HVAC system 100; however, a higher number also increases the work load on the compressor, which may reduce compressor reliability.

As noted at block 326, the outdoor fan remains energized during a short lock out in the present embodiment, but the fan may also be disabled. At block 328, a short off timer is enabled. The timer for the short lock out period is five minutes, in this embodiment. In other embodiments, the short lock out duration may range from between one and ten minutes. At block 328, the compressor run timer is reset to zero. Next the process proceeds to decision block 330 where the process waits until the short off timer expires. Once the short off timer expires, the process moves to block 332, where the short off timer is reset, other exit routines may be executed. The process then returns to block 304.

Returning to decision block 322, when the lock out counter exceeds the threshold, the process branches to decision block 334 shown in FIG. 3B. At decision block 334, the outdoor ambient temperature sensor is checked for fault. Where the outdoor ambient temperature sensor has a fault or is missing, the process proceeds to block 336 where an alert may be sent to the thermostat and default temperatures may be used. For example, absent actual data on the outdoor ambient temperatures, the outdoor ambient temperatures when the system is in a cooling mode might be assumed to be in a range of about 40 to about 70 degrees Fahrenheit (e.g. 55° F.) and in a heating mode the outdoor ambient temperatures might be assumed to be in a range of about −12 to about 20 degrees Fahrenheit (e.g. 10° F.). When the outdoor ambient temperature sensor is available and operating properly, at block 338, the process uses the outdoor ambient temperature sensed by the sensor. In either case, the process then proceeds to decision block 340 where the outdoor ambient temperature (Tamb) is measured against cool and heat mode initiate threshold temperatures. When the LPCO switch has tripped and the system is in cooling mode, the cool mode initiate threshold may be in a range of about 40-70 degrees Fahrenheit (e.g. 55 F). So in a cooling mode when the Tamb is less than, for example, 55 degrees Fahrenheit, the process proceeds to block 342. Similarly, when the LPCO switch has tripped and the system is in heating mode, the heat mode initiate threshold may be in a range of about −12 to about 20 degrees Fahrenheit (e.g. 10° F.). So in a heating mode when the Tamb is less than, for example, 10 degrees Fahrenheit, the process proceeds to block 342 as well.

At block 342, the process will initiate a long lock out until the outdoor ambient temperature rises above a release threshold temperature, which will be discussed in greater detail below. The process then proceeds to block 344 where the compressor and outdoor fan are disabled. At blocks 346 and 348 a long off timer is enabled, a compressor timer may be reset, and alerts may be sent to various systems. The process proceeds to decision block 350 where the outdoor ambient temperature sensor is checked for fault conditions. Since this sensor was previously checked, a flag or other indicator might be sufficient at this step to determine the status of the sensor. When the sensor is missing or not working properly, at block 352, default temperatures, as described above might be used as the current Tamb. When the sensor is operational, at block 354, the current Tamb would be obtained.

The method then proceeds to block 356 where the current Tamb is compared to a release threshold temperature. In a cooling mode, the release threshold temperature might be in a range of about 55 to about 75 degrees Fahrenheit (e.g. 60° F.). As such, in cooling mode when the Tamb exceeds, for example, 60 degrees Fahrenheit, the process proceeds to block 358. Similarly, in a heating mode, the release threshold might be in a range of about 0 to about 20 degrees Fahrenheit (e.g. 15° F.). As such, in heating mode when the Tamb exceeds, for example, 15 degrees Fahrenheit, the process proceeds to block 358.

At decision block 356, if the Tamb does not exceed the respective release threshold, the process returns to block 342 and the long lock out continues. It will be appreciated that when the sensor is not working or absent, the default Tamb would not increase and accordingly certain values of default temperatures might not reach the above release thresholds. Thus, the long lock out might effectively be a hard lock out. Hard lock out will be described in greater detail below.

At block 358, the process executes an exit routine to exit the long lock out, which may include resetting short lock out flags and timers and otherwise readying the system for restart. At block 360, the process returns to the start 302 in FIG. 3A.

Returning to decision block 340, the outdoor ambient temperature (Tamb) is measured against cool and heat mode initiate threshold temperatures. As described above, when the LPCO switch has tripped and the system is in cooling mode, the cool mode initiate threshold may be set to a specific temperature, such as 55 degrees Fahrenheit (e.g. 55° F.). In this case in a cooling mode when the Tamb is greater than or equal to 55 degrees Fahrenheit, the process proceeds to block 362 to perform a hard lock out. Similarly as described above, when the LPCO switch has tripped and the system is in heating mode, the heat mode initiate threshold may be set to a specific temperature, such as 10 degrees Fahrenheit (e.g. 10° F.). For example, in a heating mode when the Tamb is greater than or equal to 10 degrees Fahrenheit, the process proceeds to block 362 as well.

At block 362, the process initiates a hard lock out and disables the compressor and outdoor fan. Next at block 364, a service call alert may be initiated. At block 366, the system stays in a hard lock out until the control board is reset, such as via cycling the power by a service technician. Once the system has been reset, at block 368, the process returns to start at block 302 in FIG. 3A.

Although various steps have been described, in other embodiments, some of the steps may be omitted or reordered to promote monitoring the LPCO switch to prevent the compressor from cycling on low pressure cut out and to keep the compressor from short cycling. Method 300 is merely exemplary of one such process, and the present disclosure should not be limited to this specific implementation since others are contemplated and will suggest themselves to one skilled in the art in view of the present disclosure and teachings.

While numerous embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

Also, techniques, systems, subsystems and methods described and illustrated in the various embodiments as discrete or separate may be combined or integrated with other techniques, systems, subsystems or methods without departing from the scope of the present disclosure. Other items shown or discussed as coupled or directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A system, comprising:

a compressor;

a heat exchanger;

at least one refrigerant line to promote communication of refrigerant between the compressor and the heat exchanger;

a low pressure cut out (LPCO) switch to promote disabling the compressor based on a system pressure;

an ambient temperature sensor configured to determine an ambient temperature; and a control component coupled to communicate with the LPCO switch and the ambient temperature sensor, the component configured to determine a mode state of the system and to disable the compressor based on a status of the LPCO switch, the ambient temperature, and the mode state;

wherein when the LPCO status is open and the system is in a cooling mode state, the control component configured to initiate one or more short lock out durations and a hard lock out duration based on a maximum threshold number of short lock outs; and wherein the short lock out durations comprise a substantially predetermined total length of time.

2. The system of claim 1, wherein the threshold number of short lock outs is in a range from about 1 to 4 lock outs.

3. The system of claim 2, wherein on a short lock out the control component disables the compressor for about 1 to 10 minutes.

4. The system of claim 2, wherein when the ambient temperature is less than a first ambient threshold and wherein the number of short lock outs within a time period is above the maximum threshold number of lock outs, the component configured to disable the compressor until the ambient temperature reaches a second ambient threshold.

5. The system of claim 4, wherein the first ambient threshold is in a range of from about 44 through 70 degrees Fahrenheit and where the second ambient threshold is in a range of from about 55 through 75 degrees Fahrenheit.

6. The system of claim 5, wherein when the ambient temperature is greater less than the first ambient threshold and wherein the number of short lock outs within a time period is above the maximum threshold number of lock outs, the control component configured to disable the compressor until a system reset.

7. The system of claim 4, wherein when the ambient temperature is less than the first ambient threshold and wherein the number of short lock outs within a time period is above the maximum threshold number of lock outs, the component configured to disable the compressor until the ambient temperature reaches the second ambient threshold.

8. The system of claim 1, wherein when the LPCO status is open and the system is in a heating mode state, the component configured to initiate one or more short lock out durations and a hard lock out based on a maximum threshold number of short lock outs.

9. The system of claim 8, wherein the threshold number of short lock outs is in a range from about 1 to 4 lock outs.

10. The system of claim 9, wherein on a short lock out the control component disables the compressor for about 1 to 10 minutes.

11. The system of claim 9, wherein when the ambient temperature is less than a first ambient threshold and wherein the number of short lock outs within a time period is above the maximum threshold number of lock outs, the control component configured to disable the compressor until the ambient temperature reaches a second ambient threshold.

12. The system of claim 11, wherein the first ambient threshold is in a range of from about −12 through 10 degrees Fahrenheit and where the second ambient threshold is in a range of from about 0 through 20 degrees Fahrenheit.

13. The system of claim 12, wherein when the ambient temperature is greater less than the first ambient threshold and wherein the number of lock outs within a time period is above the first threshold number of lock outs, the component configured to disable the compressor until a system reset.

14. The system of claim 11, wherein when the ambient temperature is less than the first ambient threshold and wherein the number of short lock outs within a time period is above the maximum threshold number of lock outs, the control component configured to disable the compressor until the ambient temperature reaches the second ambient threshold.

15. A method, comprising:

determining a mode state of a system;

determining a status of an LPCO switch;

determining an ambient temperature; and selectively disabling a compressor based on a status of the LPCO switch, the ambient temperature, and the mode state;

wherein when the LPCO status is open and the system is in a cooling mode state; further comprising initiating one of a short lock out and a hard lock out duration based on first threshold number of short lock outs; and wherein each short lock out duration comprises a substantially predetermined total length of time.

16. The method of claim 15, wherein the first threshold number of short lock outs is in a range from about 1 to 4 lock outs.

17. The method of claim 16, wherein when the ambient temperature is less than a first ambient threshold and wherein the number of short lock outs within a time period is above the first threshold number of short lock outs, the method further comprises disabling the compressor until the ambient temperature reaches a second ambient threshold.

18. The method of claim 17, wherein the first ambient threshold is in a range of from about 44 through 70 degrees Fahrenheit and where the second ambient threshold is in a range of from about 55 through 75 degrees Fahrenheit.

19. The method of claim 18, wherein when the ambient temperature is greater less than the first ambient threshold and wherein the number of short lock outs within a time period is above the first threshold number of short lock outs, the method further comprises disabling the compressor until a system reset.

20. The method of claim 17, wherein when the ambient temperature is less than a first ambient threshold and wherein the number of short lock outs within a time period is above the first threshold number of short lock outs, the method further comprises disabling the compressor until the ambient temperature reaches a second ambient threshold.

21. The method of claim 15, wherein on a short lock out the compressor is disabled for about 1 to 10 minutes.

22. The method of claim 15, wherein when the LPCO status is open and the system is in a heating mode state, further comprising initiating one of a short lock out and a hard lock out duration based on first threshold number of lock outs.

23. The method of claim 22, wherein the first threshold number of short lock outs is in a range from about 1 to 4 lock outs.

24. The method of claim 22, wherein on a short lock out the compressor is disabled for about 1 to 10 minutes.

25. The method of claim 22, wherein when the ambient temperature is less than a first ambient threshold and wherein the number of short lock outs within a time period is above the first threshold number of short lock outs, the method further comprises disabling the compressor until the ambient temperature reaches a second ambient threshold.

26. The method of claim 25, wherein the first ambient threshold is in a range of from about 44 through 70 degrees Fahrenheit and where the second ambient threshold is in a range of from about 55 through 75 degrees Fahrenheit.

27. The method of claim 26, wherein when the ambient temperature is greater less than the first ambient threshold and wherein the number of short lock outs within a time period is above the first threshold number of short lock outs, the method further comprises disabling the compressor until a system reset.

28. The method of claim 25, wherein when the ambient temperature is less than the first ambient threshold and wherein the number of short lock outs within a time period is above the first threshold number of short lock outs, the method further comprises disabling the compressor until the ambient temperature reaches the second ambient threshold.

29. A system, comprising:

a compressor;

a heat exchanger;

at least one refrigerant line to promote communication of refrigerant between the compressor and the heat exchanger;

a low pressure cut out (LPCO) switch to promote disabling the compressor based on a system pressure;

an ambient temperature sensor configured to determine an ambient temperature; and a control component coupled to communicate with the LPCO switch and the ambient temperature sensor, the component configured to determine a mode state of the system and to disable the compressor based on a status of the LPCO switch, the ambient temperature, and the mode state;

wherein the mode state of the system is one of a cooling mode state and a heating mode state;

wherein when the LPCO status is open and the system is in a cooling mode state, the control component configured to initiate one or more short lock out durations and a hard lock out duration based on a maximum threshold number of short lock outs;

wherein when the ambient temperature is less than a first ambient threshold and wherein the number of short lock outs within a time period is above the maximum threshold number of lock outs, the component configured to disable the compressor until the ambient temperature reaches a second ambient threshold; and wherein the threshold number of short lock outs is in a range from about 1 to 4 lock outs.

30. A method, comprising:

determining a mode state of a system;

determining a status of an LPCO switch;

determining an ambient temperature; and selectively disabling a compressor based on a status of the LPCO switch, the ambient temperature, and the mode state;

wherein when the LPCO status is open and the system is in a cooling mode state, further comprising initiating one of a short lock out and a hard lock out duration based on first threshold number of short lock outs;

wherein the first threshold number of short lock outs is in a range from about 1 to 4lock outs; and wherein when the ambient temperature is less than a first ambient threshold and wherein the number of short lock outs within a time period is above the first threshold number of short lock outs, the method further comprises disabling the compressor until the ambient temperature reaches a second ambient threshold.

* * * * *